US006588356B2

(12) United States Patent
Buchanan

(10) Patent No.: US 6,588,356 B2
(45) Date of Patent: Jul. 8, 2003

(54) WATER HOOK

(76) Inventor: Rod Buchanan, 18910 Bothell-Everett Hwy., Bothell, WA (US) 98012

( * ) Notice: Subject to any disclaimer, the term of this patent is extended or adjusted under 35 U.S.C. 154(b) by 57 days.

(21) Appl. No.: 09/727,156

(22) Filed: Nov. 29, 2000

(65) Prior Publication Data

US 2002/0062776 A1 May 30, 2002

Related U.S. Application Data

(60) Provisional application No. 60/167,734, filed on Nov. 29, 1999.

(51) Int. Cl.[7] ..... B63B 9/00

(52) U.S. Cl. ..... 114/221 R; 416/70 R

(58) Field of Search ..... 441/76, 55–59; 114/221 R; 440/101, 102, 103, 104, 105; 294/19.1; 315/15.1, 16, 17, 18; 416/69, 70 R, 71–74

(56) References Cited

U.S. PATENT DOCUMENTS

| | | | | | |
|---|---|---|---|---|---|
| 31,608 | A | * | 3/1861 | Kleiber | 441/56 |
| 172,380 | A | * | 1/1876 | Bockstaller | 135/16 |
| 289,224 | A | * | 11/1883 | Clarke | 114/311 |
| 314,734 | A | * | 3/1885 | Smith | 416/68 |
| 571,858 | A | * | 11/1896 | Haven | 441/56 |
| 728,330 | A | * | 5/1903 | Temperley et al. | 114/311 |
| 817,810 | A | * | 4/1906 | Sheen | 416/68 |
| 826,693 | A | * | 7/1906 | Sheen | 440/101 |
| 845,659 | A | * | 2/1907 | Luce | 441/56 |
| 1,115,343 | A | * | 10/1914 | Spradling | 441/56 |
| 2,477,410 | A | | 7/1949 | Johnson | |
| 2,599,791 | A | * | 6/1952 | Swenson | 416/68 |
| 2,702,910 | A | | 3/1955 | Ake | |
| 3,030,641 | A | | 4/1962 | Ake | |
| 3,032,047 | A | * | 5/1962 | Wendorf | 135/33.7 |
| 3,040,693 | A | | 6/1962 | Bunker | |
| 3,800,734 | A | * | 4/1974 | Whang | 440/13 |
| 3,918,385 | A | | 11/1975 | Wallace | |
| 4,068,610 | A | * | 1/1978 | Tesan | 440/101 |
| 4,578,038 | A | * | 3/1986 | Lenten | 440/19 |
| 4,653,219 | A | * | 3/1987 | Kaupert | 43/43.1 |
| 4,718,188 | A | * | 1/1988 | Roberts | 43/4 |
| 4,897,062 | A | * | 1/1990 | Watson | 440/101 |
| 4,998,551 | A | * | 3/1991 | DeSarno | 135/15.1 |
| 5,144,904 | A | * | 9/1992 | Weldon | 114/311 |
| 5,163,778 | A | | 11/1992 | Botero | |
| 5,593,334 | A | * | 1/1997 | Thayer | 441/77 |

FOREIGN PATENT DOCUMENTS

| | | | | |
|---|---|---|---|---|
| FR | 739079 | * | 1/1933 | 441/61 |

* cited by examiner

*Primary Examiner*—S. Joseph Morano
*Assistant Examiner*—Ajay Vasudeva
(74) *Attorney, Agent, or Firm*—Joe Chalverus

(57) ABSTRACT

A water craft propulsion tool providing a means to propel a water craft through its floating medium, uses an extended member with a handle on one end and a water grasper, that is a device having high resistance to fluid flow on the other end. By pulling the grasper through the floating medium, a drag force is applied to move the craft in the direction of the pull. The tool is also used in combination with a docking pole having a handle, an extended member and a hook-bumper at the other end.

26 Claims, 6 Drawing Sheets

WATER HOOK

PRIOR PROVISIONAL PATENTS

The inventors claim benefit of the provisional co-pending patent application entitled water hook filed by Rod Buchanan, filed on Nov. 29, 1999 with the U.S. Patent Office, No. 60/167,734.

BACKGROUND OF THE INVENTION

1. Field of the Invention

The present invention relates generally to means to move and control a boat through a floating medium such as water without use of a motor or sail propulsion. More specifically this invention relates to means used to propel a craft towards a desired location, such as a dock or shore or another water craft, by engaging the water with a hand-held device.

2. Description of the Related Art

Hand held paddles and oars are known in the prior art to include generally a flat member portion and extended member terminating in a handle. Paddles are designed to be used by holding the handle with one hand and towards the middle of the paddle with the other hand. The working or flat end of the paddle is placed in the water and then by pulling the paddle with the hand towards the center of the pole and pushing the paddle with the first hand, the boat is propelled. Paddles are commonly used to propel small, usually narrow craft such as canoes and kayaks. Oars are usually used in pairs. The oars are similar in construction to paddles. The oars are placed in oar locks. The oar lock constrains the mid portion of the oar to act as a pivot, so that when the handle end of the oar is pulled towards the fore part of a boat, the flat end of the oar engages the water to propel the boat towards forward. Oars are most commonly used in small boats, wider than canoes and kayaks, called row boats.

Oars and paddles are usually considered to be the primary sources of propulsion os small water craft such as in canoes, kayaks and row boats. Oars and paddles are often considered auxiliary propulsion means to small motor or sail boats. When the size of the boat exceeds fifteen feet primary propulsion systems such as motors or sails are used, oars and paddles becoming very difficult and tedious to use.

A typical problems for boats is docking or approaching other water craft. Often because of unpredictable current or winds, it is difficult to safely move a boat to a dock or other location at a speed that avoids collision with the dock or other objects. There are several strategies for boats with motors or sails to minimize collisions with the dock. For example, one method is to approach the dock into the wind to provide a shorter stopping distance, while a crew member stands fore to repel the boat from the dock should the speed be too fast for safe moorage or grasp a line or other part of the dock or other boat for moorage. Only experience and luck provide a perfect speed of the boat to bring the boat to the dock or objective and within grasping distance without forward moment that may endanger the boat or other craft.

A common tool used by many boatmen is the boat mooring tool or docking pole. The docking pole expands the distance from the dock to which the pilot must bring the boat, from an arm-length to the length of the docking pole. A docking pole comprises a extended central member with a hook element and bumper means at a working end and a handle or grasping means at the other end. The hook element permits a line or other object to be pulled while the bumper means stays or repels the boat from the dock or other objects during the docking procedure. The pole is often made of wood or aluminum, is ideally light weight. Docking poles are often available with telescoping sections to extend the working end much farther than conventional poles, but collapsible to a smaller length for storage. The collapsing docking pole can be reduced in size to approximately the length of a common, non-extendable docking pole.

As often happens, even with an extended docking pole, the boat will not be brought within grasping distance of the dock. In this event the primary propulsion system must often be deployed to propel the craft closer to the dock. In the instance of a sail boat, this can be a daunting task, since sails must be opened. In the instance of a motor boat, careful control of the engine will be needed to avoid collision with other boats and dangers.

Ongoing efforts have been made to find a safe, simple and convenient means to slowly and safely propel a boat closer to a mooring position at a dock or other craft without deploying the primary propulsion system. Some boaters use the common oar or paddle. For reasons expressed above, these tools have proved to be difficult and sometimes ineffective because the of the limitations of their designs.

More specifically, it has been sought to develop a tool which can be used to propel a water craft in situations where the craft need be moved only a short distance to be within a grasping distance. The tool must be convenient to use, effective and available whenever the situation arises as described above. Ideally, the tool should be lightweight and compact yet work unfailingly whenever needed, perhaps in conjunction with other common tools used at the time of docking a boat.

BRIEF SUMMARY OF THE INVENTION

My invention is particularly useful as a means to provide a safe approach of a boat to a dock in where it is important to avoid a collision of the boat to the dock. It takes advantage of the fact that certain shaped items provide a fluid drag that could be used to propel a boat slowly through water.

My invention is a water craft propulsion tool providing for a means to propel a water craft through its floating medium. The invention uses an extended member such as a pole having a handle on one end to manipulate the working end of the tool and a water grasper on the other end. The water grasper is an element that provides high resistance to fluid flow when pulled. By pulling the tool through the floating medium, a drag force is applied to move the craft in the direction of the pull. The tool is used as described or in combination with a known, simple water craft tool commonly known as a docking pole, an extended member such as a pole having a handle on one end to manipulate the working end of the tool and a line hook-mar resistant bumper at the working end.

That is, my tool may be used alone or when used in combination with a docking pole to first propel a water craft towards a dock, then when the craft is within grasping reach of the working end of the docking pole, the elements can be used to safely dock the water craft.

In use, the working end of my invention is placed into the water and pulled. The resistance to flow of the floating medium produces a drag in proportion to the pulling force which is balanced by the boat moving in the direction of the pulling force.

When my invention is used in combination with a docking pole, the water grasping element is provided with a means to retreat from the working end or to collapse in order to avoid interference the hook and bumper means.

My invention provides for a number of alternate fluid grasping elements comprising rigid shapes and configurations, some moving between a working end and a medium position, others opening and closing in the manner as an umbrella, with rotatively mounted support ribs, rectangular grasping elements in various shapes, such as a hoe or shovel, other multiple fluid grasping elements laterally extending from the extended member. The invention also contemplates other fluid grasping elements of flexible membranes such as NYLON or canvas attached to rigid supports that rotate between pulling and pushing as well as flexible membranes that expand and contract with flexible lines or cords.

Both rigid and flexible grasping elements as described in these specification provide for high fluid resistance when expanded and low fluid resistance when collapsed, the flexible members fully open to engage the fluid and propel the boat forward when the tool is pulled; the flexible members closed or collapsed when the tool is pushed through the floating medium.

Accordingly, it is a general object of the present invention to provide a means to propel a boat through its floating medium in a safe and secure manner.

It is also an object of the present invention to provide a means to propel a boat in water towards a dock or shore which is convenient, with minimum effort and maximum control.

It is another object of the present invention to attain the foregoing objects and also to provide a safe, convenient way to slowly propel the boat closer to the dock without deploying the primary propulsion system without the use of the common oar or paddle.

It is further an object of my invention to provide for a tool which can be used to propel a boat in situations where the boat need be moved only a short distance to reach a dock grasping distance. Further objectives of my invention include the advantages of a tool that is convenient to use, effective and available whenever the need arises, a tool that is also lightweight and compact yet works unfailingly whenever needed. Lastly, my tool is designed to be used in conjunction with another common tool, a docking pole to take advantage of the handle and extended member features of that device Further objects and advantages of my invention will become apparent from a consideration of the drawings and ensuing description thereof.

DESCRIPTION OF THE PREFERRED EMBODIMENTS

Figure 1:
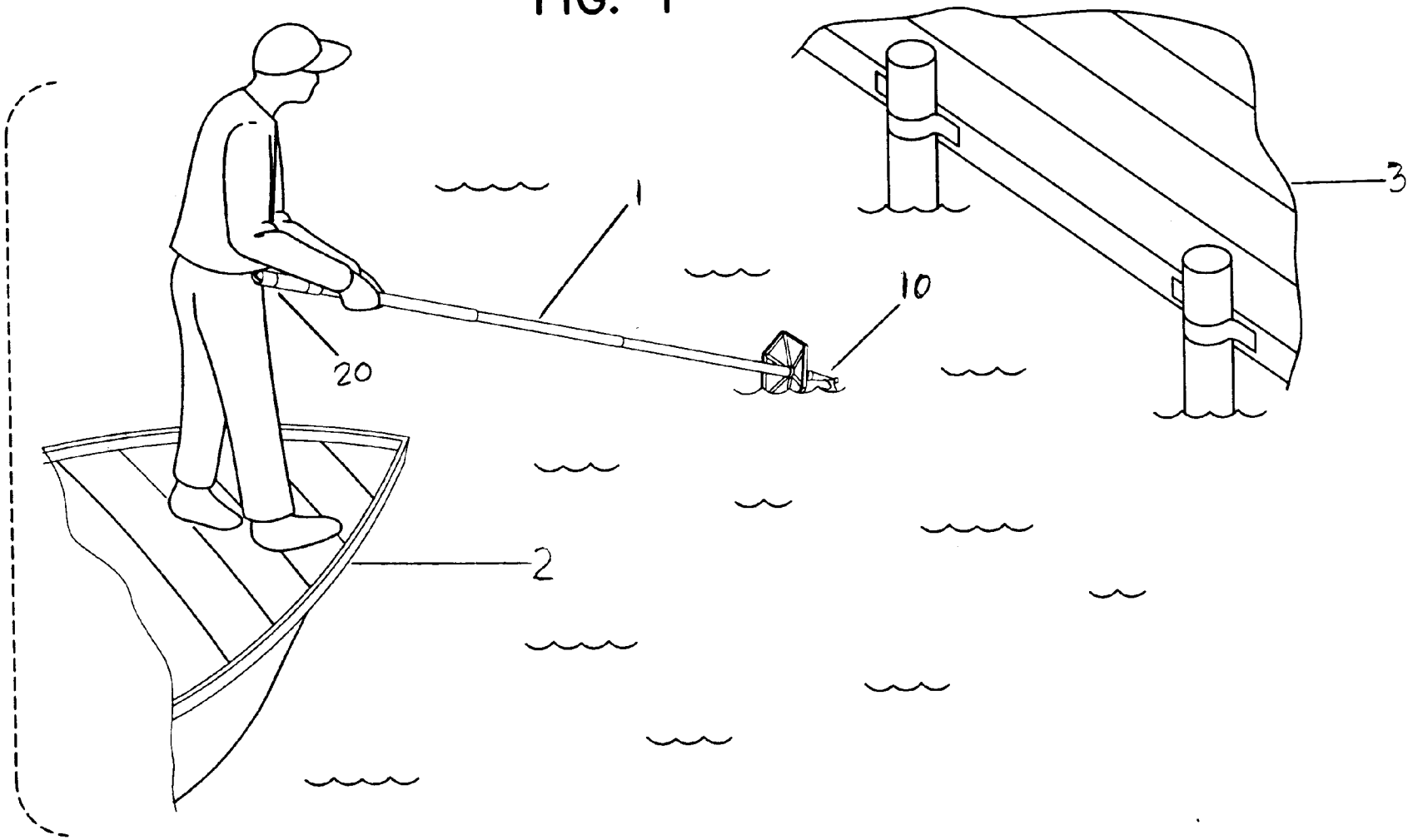
FIG. 1 Perspective of the water hook in use to propel a boat towards a dock or mooring platform.

My water hook, shown generally in FIG. 1 as 1 is used by a crew to propel a boat 2 slowly in the direction desired, shown in FIG. 1 to be a dock 3 or mooring area. In this embodiment, my invention is used in conjunction with a docking pole. While my invention need not be used in conjunction with a docking pole, my invention is particularly useful when it takes advantage of the common elements of a docking pole. In this configuration, the tool 1 comprises an extended center portion 15 spanning between a handle end 20 and a working end 10. The working end 10 of the docking pole has a docking bumper tip 11, used to make contact with objects to be pushed. This docking bumper tip 11 is usually made of a rubberized material to prevent marring and round to minimize denting should it be used to push boats and water craft that have soft or breakable surfaces or shells. Immediately adjacent to the docking bumper tip 11 is a hook element 12, for grasping, catching, holding or pulling lines and other objects, the hook element 12 having a support framework, 13, a curved portion 14 at an cushion end 19. The cushion 19 is usually made of a rubberized material to prevent marring and round to minimize denting in a manner similar to the bumper tip 11.

Figure 2:
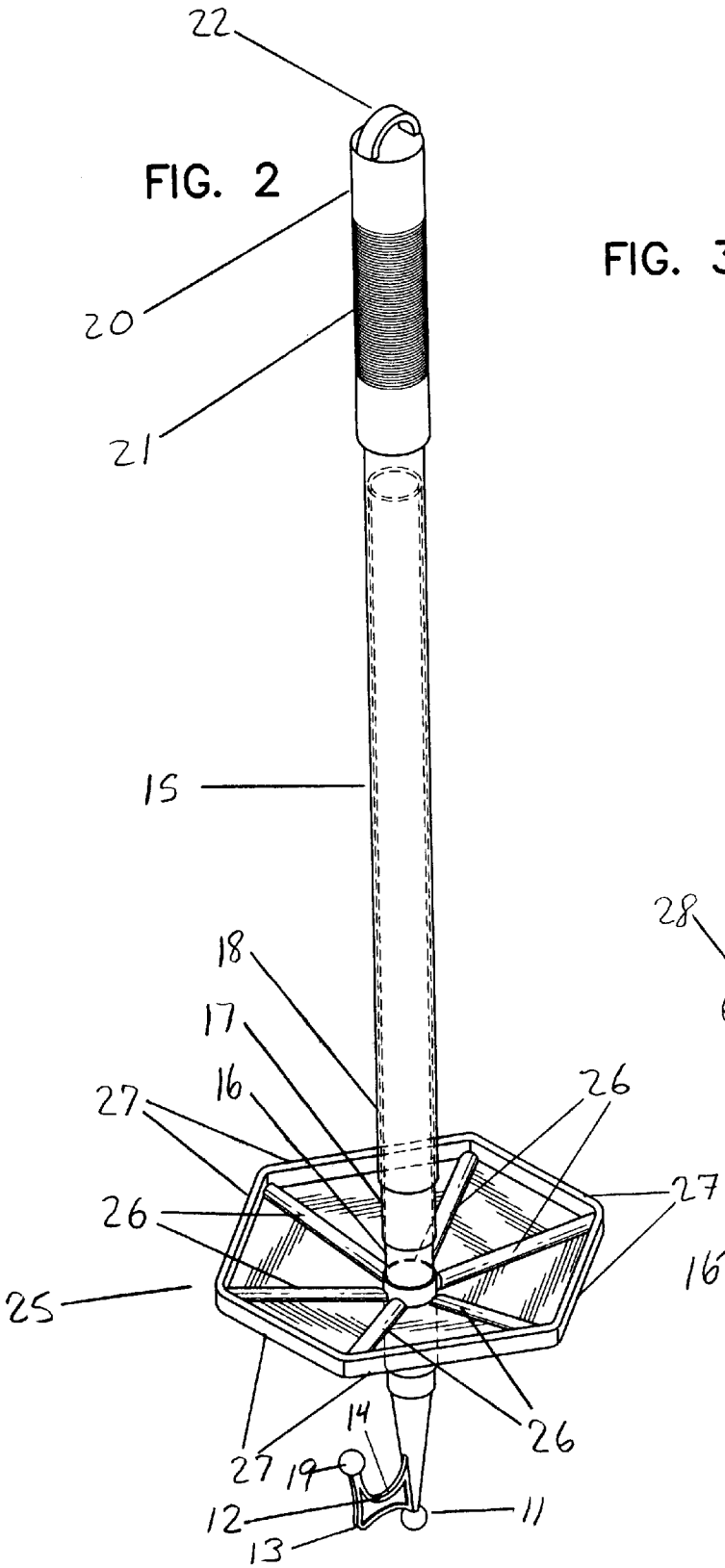
FIG. 2 a side view of my invention in combination with a docking pole in the compact configuration.

The center portion 15 can be made of in a solid unit or as shown here, with telescoping tubes of progressively decreasing sizes to permit lengths of the center portion 15 to telescope within each other to form a compact unit for storage but to extend to a maximum length for use. FIG. 2 shows three telescoping tubes 16. 17 and 18, with interlocking latches within the tubular sections to permit the tool to be extended to nearly three times the length of any one of the tubes as shown in FIG. 3.

The handle end 20 has a friction element 21 to assist in holding the tool by one or more hands and an end loop 22 to facilitate hanging the tool 1 for storage. The friction element 21 could be of a rubberized material that is soft on the hands yet malleable to permit a solid grip of the tool when needed.

My invention attaches a fluid grasper element 25 comprising a hexagonal shaped disk with a centered opening sized to the center portion 15 of the tool. The disk has a concaveture towards the user to maintain a maximum of drag force in the pulling direction. The element 25 may be constructed of any light-weight rigid material such as, wood, aluminum, polyethylene or other similar material that does not deteriorate in water. To minimize distortion and to maintain the concave shape of the disk, this grasper element 25 uses radially aligned support ribs 26 and a six circumferential or peripheral support ribs 27.

Figure 3:
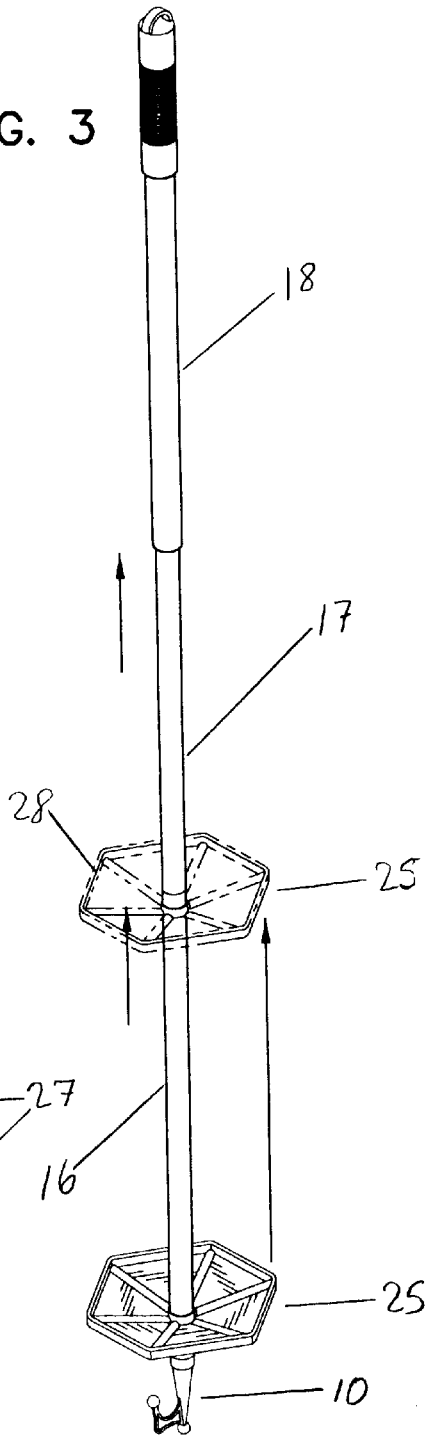
FIG. 3 A side view of my invention in the extended position with arrows indicating the extreme positions of the fluid grasping element from a working end to a central area.

The fluid grasping element 25 is free to slide along the center portion 15 from the working end to a center position on the center portion 15 of the tool as shown by 28 the broken lines in FIG. 3. The invention is used to propel a boat through water as shown in FIG. 1 by placing the working end into the water and pulling the handle, the grasping element 25 interacting with the water by its concave shape, first by sliding to the working end, then providing a hydraulic drag sufficient to move the boat 2 to counter the pulling force. By successive pulling of the tool, the boat 2 is propelled in a controlled manner toward a desired location, such as the dock 3.

When used in conjunction with a docking pole, when boat is near the dock 3, or other objective, then the tool is used to assist in docking in the usual manner. The water grasping element 25 is placed towards the centered position 28 away from the working end. This is easily accomplished by raising the tool towards the vertical letting gravity help slide the grasping element 25 away from the working end 10 and towards the center of the extended portion 15 as shown by the arrows in FIG. 2, or by pushing the tool through the water, the fluid pushing the element 25 away from the working end. When element 25 is placed away from the working end, the water grasping element 25 will not interfere with the bumper end 10 of the line grasping or hook element 12 may be used in the docking process. When the element is not used in conjunction with the docking pole, there is no need for the element 25 to be moved from the working end. The tool can then be used by placing the working end into the floating medium and pulling, removing from the water and pulling again as often as needed.

The hexagonal shape of element 25 has the advantage of preventing the tool from rolling when the tool is not in use and placed on a moving deck.

As can be appreciated, in both cases the purpose of the water grasping element at the working end 10 is to provide a drag force that propels a boat by pulling the tool through the floating medium. Objects with shapes other than the hexagonal shaped element 25 also provide drag forces, however.

Figure 4:
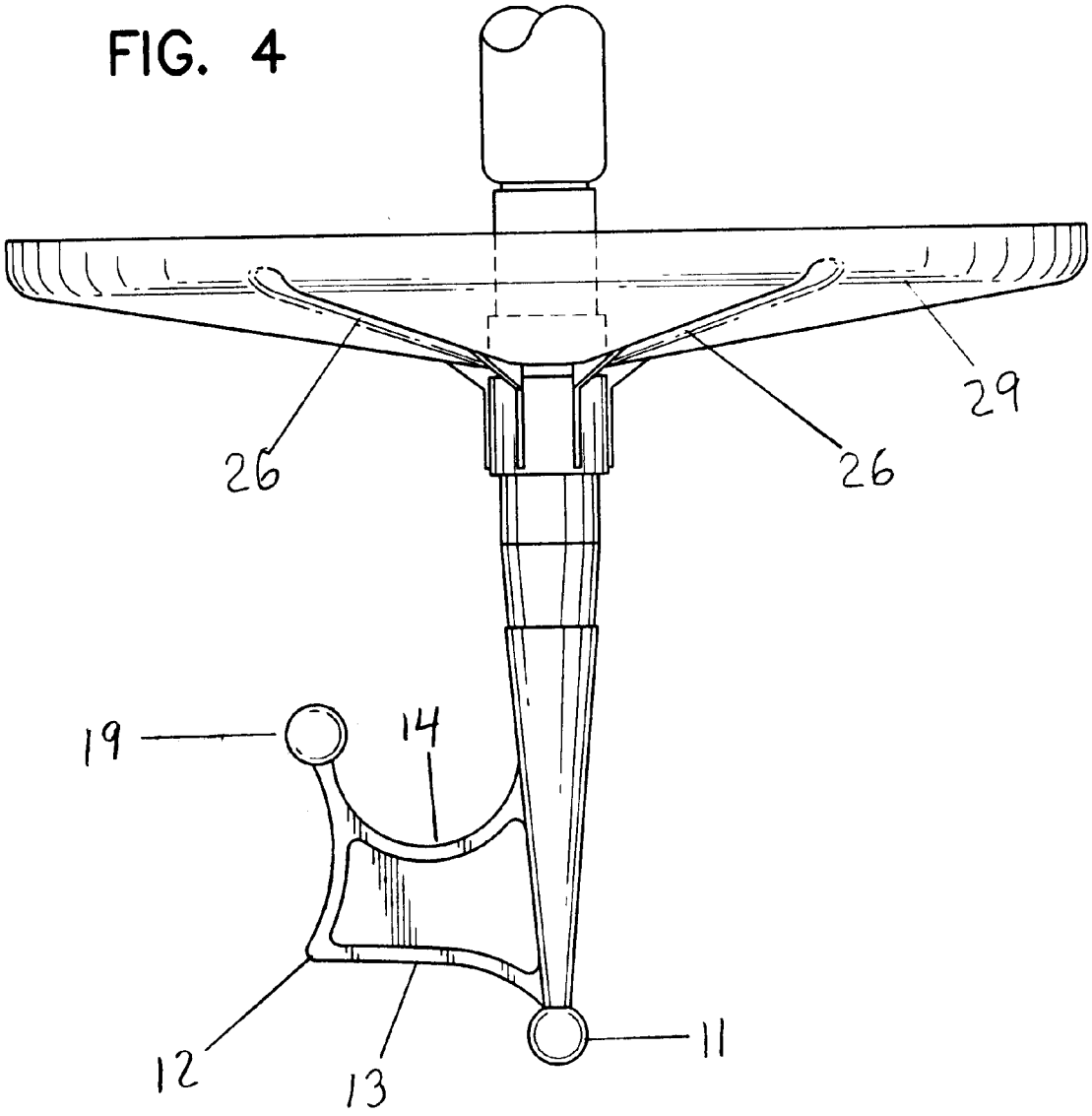
FIG. 4. an exploded side view of the working end of my invention with a rigid hexagonal fluid grasping element.
Figure 5:
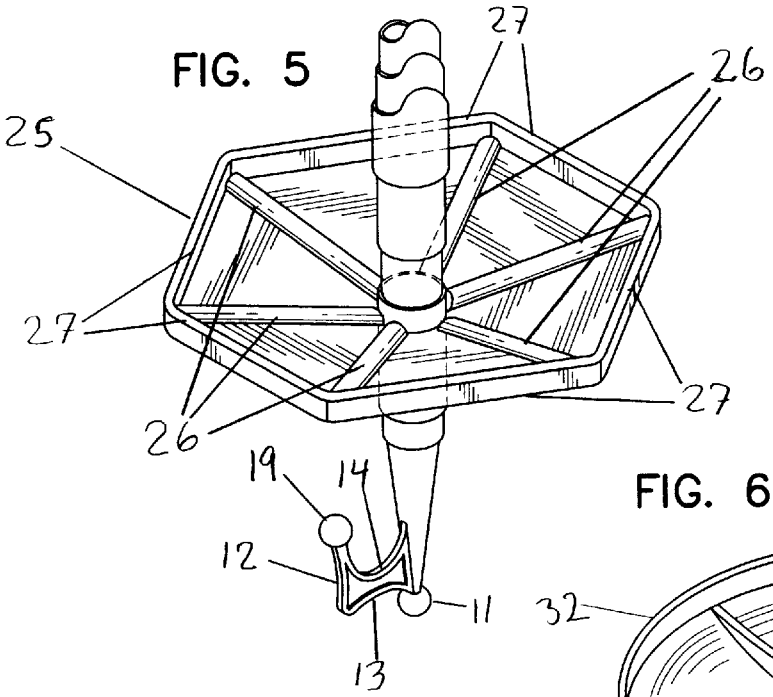
FIG. 5. an exploded perspective view of the working end of my invention having a rigid hexagonal fluid grasping element.

When rolling is not of consequence, then the water grasping element may be circular as shown in FIG. 4 where the circumferential support 29 is circular, with a concavity towards the user. When this water grasping element is used in conjunction with a docking pole, the element 29 should be attached to the extended central portion 15 to slide between the working end 10 and the mid location 28, as described above. Otherwise, the grasper element can be fixed at the working end without need for movement.

Figure 6:
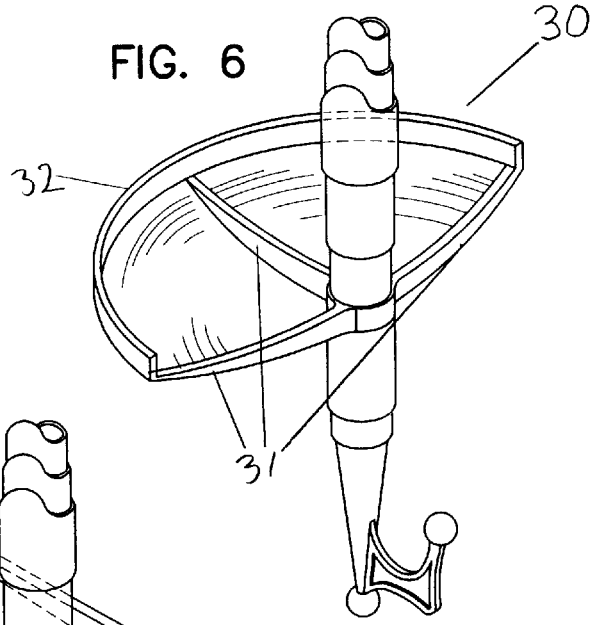
FIG. 6. an exploded perspective view of the working end of my invention having a rigid semicircular fluid grasping element.

FIG. 6 shows a semicircular, fluid grasping element 30 having radially oriented ribs 31 and circular support element 32 with of the element 30 a concavature towards the user. This semicircular configuration has the advantage of not rolling. Except for the shape, the grasping element 30 attaches to the extended center portion 15 and operates in the same manner as grasper element 25.

Figure 7:
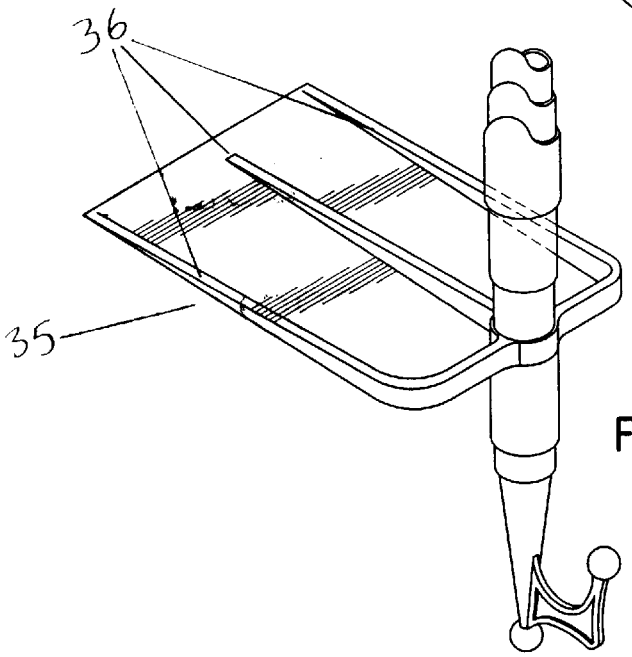
FIG. 7. an exploded perspective view of the working end of my invention with a rigid rectangular fluid grasping element.

FIG. 7 teaches a rigid rectangular grasping element 35 having parallel support 36 ribs, the element 35 attached to the extended center portion 15 with a concavature towards the user. This element 35 operates in the same manner as fluid grasping element 25 and slides along the extended member from the working end 10 to a center portion 28 to use the boat hook 11 or bumper element 12.

Figure 8:
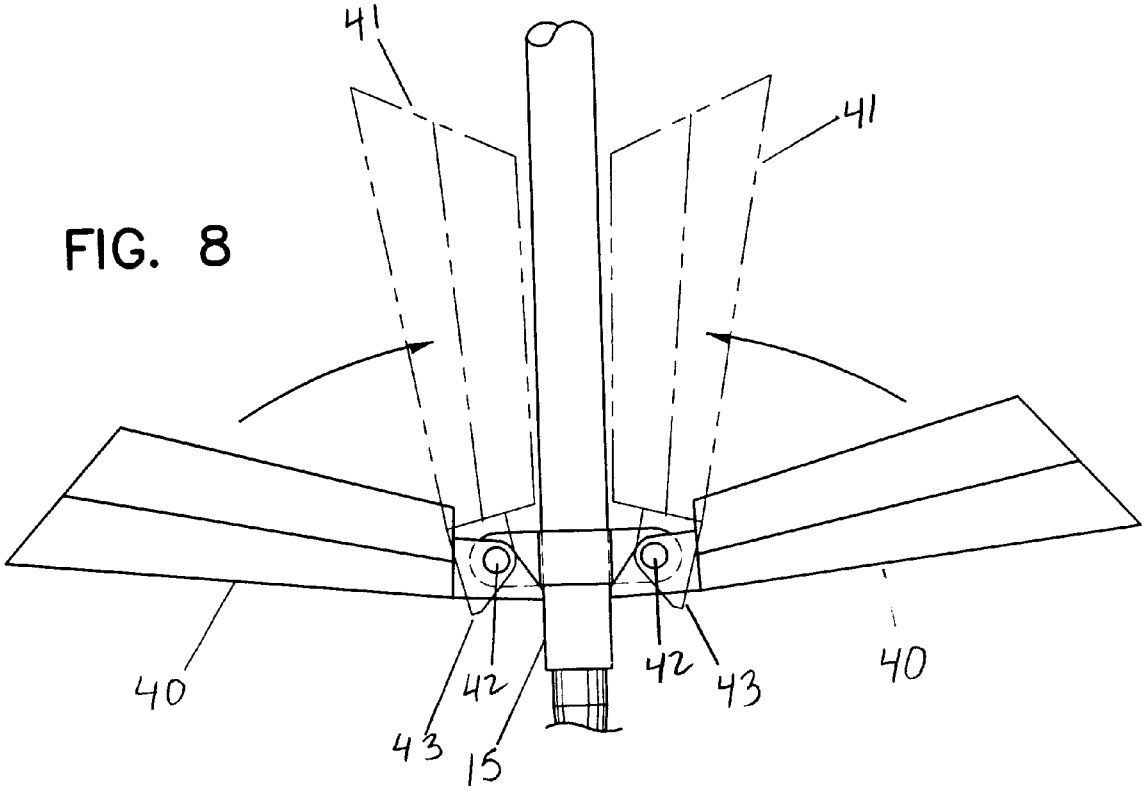
FIG. 8. an exploded side view of the working end of my invention with a pair of rectangular wings or fluid grasping elements pivotally attached to the extended central member.

FIG. 8 teaches a water hook having a pair of wings, or rectangular fluid grasper elements 40 rotatively fixed at the working end 10 of the tool, from an extended configuration as shown with solid lines to a contracted configuration as shown in the broken lines 41. When used with a docking pole this variation of a water hook not need slide from the working end 10 since the wings 40 rotate at pivot 42 to remove the fluid grasping elements 40 from interfering with the working end 10 of the tool. When the tool is needed to pull a boat through the water, the tool is placed into the water and pulled, the water interacting with the elements 41 to rotate the wings to the position marked as 40, the wings 40 are prevented from further rotation by nibs 43 located on the elements 40 near the base impinging upon extended center portion 15 when fully extended.

While the above teaches rigid fluid grasping elements, grasping elements such as wings 40, these fluid grasping elements may also be made of flexible membranes, such as NYLON or canvas with suitable support structures. For example, FIG. 9 teaches a water hook with a flexible membrane fluid grasping element 45 with support ribs 46 rotatively fixed at 47 near the working end 10 of the tool. When the tool is pulled, the flexible membrane 45 interacts with the water to billow open to the extend permitted by the membrane, providing the drag needed to propel a boat. To use, the working end 10 is pushed through the water, the ribs 46 with the flexible member 45 aligning along the extended member 15. Then when the working end 10 is pulled, the flexible member with the ribs 46 billows open to provide drag. By successive pushing then pulling, the boat 1 can be propelled towards the direction desired.

Figure 10:
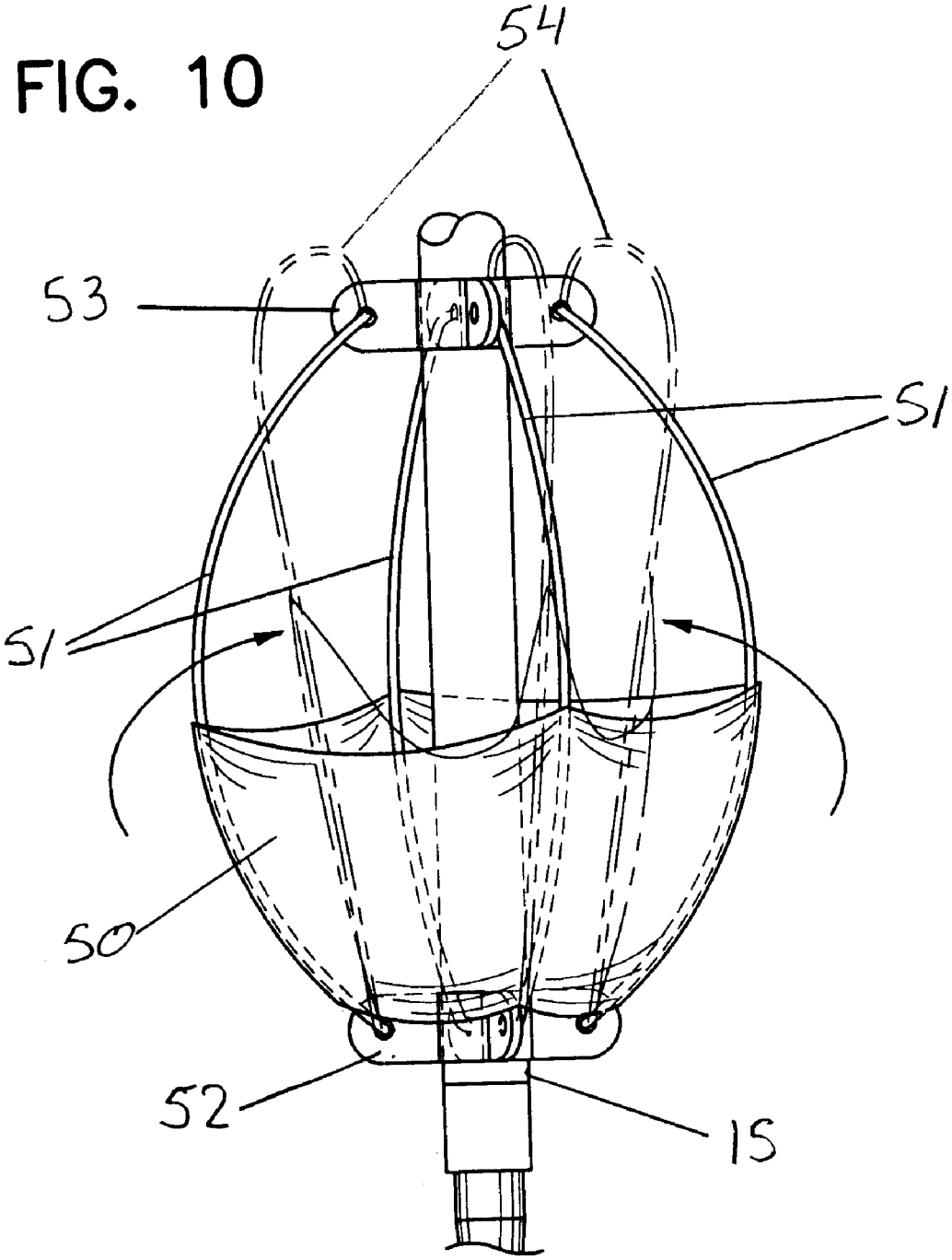
FIG. 10. an exploded side view of the working end of my invention with a flexible members supported by a plurality of flexible support members or cords in the open and collapsed configuration.

FIG. 10 teaches a water hook with a flexible membrane 50 attached to several flexible lines or cords 51 loosely spanning between a collar or attachment ring 52, located closest to the working end 10 and collar or attachment ring 53 closer to the center of the extended member 15. While there is no limit to the number of cords or flexible lines 51 that can be used, the least number that will ensure proper billowing of the flexible membrane is four, symmetrically aligned around the rings 52 and 53. To use, the working end 10 is pushed through the water, the flexible membrane 50 closed and limp with the several flexible lines 51 as shown by the broken lines 54. Then, when the tool is pulled, the flexible membrane 50 catches the floating medium to billow open to the extend permitted by the several flexible lines 51. By successive pushing then pulling, the boat 1 can be propelled towards the direction desired.

Figure 9:
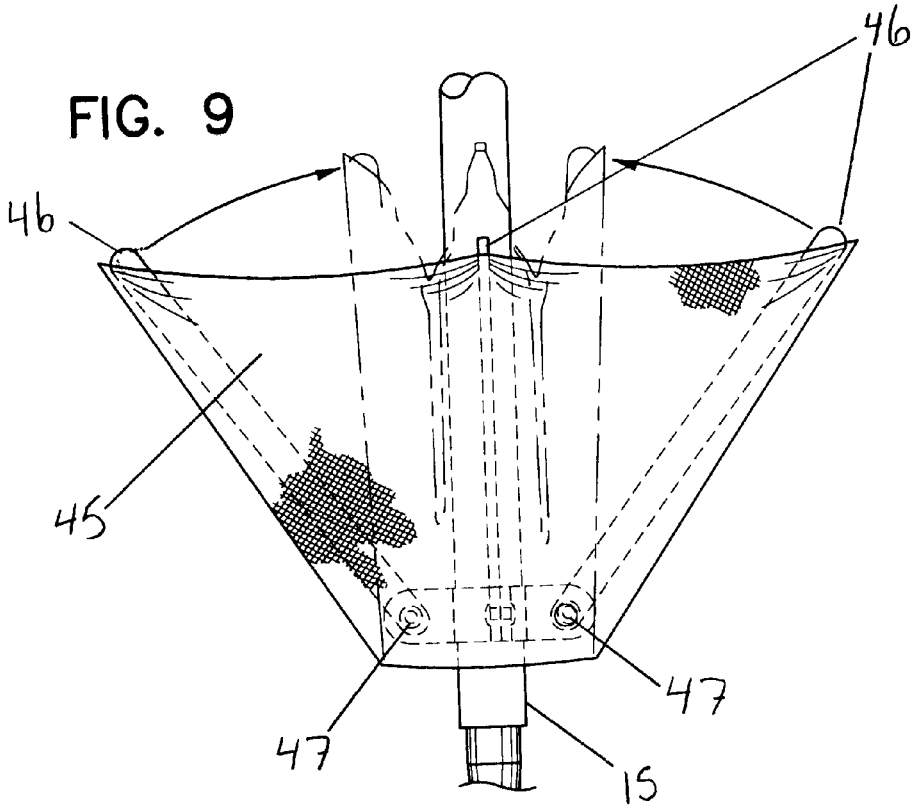
FIG. 9. an exploded side view of the working end of my invention with a flexible members supported by a plurality of rigid support members to open and collapse in an umbrella manner.

While the above description contains many specifications, there should not be construed as limitations on the scope of the invention, but rather as an exemplification of one preferred embodiment thereof. Many other variations are possible, for example while I have detailed various drag elements that can be used as water grasping elements, it should be clear that these are not the only water grasping elements available for use. For example, not shown are water grasper using radially aligned or other shaped arrays of cups of various shapes and sizes and the like that will provide drag to move the boat in water. Furthermore, while I show that the water grasper is slidable between the working end 10 and the centered area 27, it should be clear that the water grasper need not be slidable as shown in FIGS. 8,9 and 10 since the grasper elements are easily made to not interfere with the boat hook when needed. Accordingly, the scope of the invention should be determined not by the embodiment illustrated, but by the appended claims and their legal equivalents.

What is claimed is:

1. A water hook used in combination with a boat-hook, said boat-hook having a handle at one end of a central extended member and a working end with a mar resistant bumper and a line grasping means at an other end of the extended member, the water hook comprising:

a water grasping element at the working end of said extended member;

the water grasping element having a high fluid resistance to movement propelling said craft whenever said water grasping element is pulled by the handle from said craft through the fluid medium;

a means for the water grasping element to retreat from said working end whenever said boat-hook is needed.

2. The water hook of claim 1 wherein said water grasping element is an concave disk with the concavity directed towards the handle, the disk slidingly attached to the central extended member, said disk sliding towards the working end whenever said water hook is pulled, said disk sliding towards a center of said central extended member whenever said hook is raised towards a vertical or pushed through the fluid medium.

3. The water hook of claim 2 where said concave disk is hexagonal.

4. The water hook of claim 3 having radially oriented and circumferential oriented supporting structure to minimize distortion, of said disk when pulled.

5. The water hook of claim 2 having radially oriented and circumferential oriented supporting structure to minimize distortion of said disk when pulled.

6. The water hook of claim 1 wherein said water grasping element is a semicircular disk with the concavity directed towards the handle, the semicircular disk slidingly attached to the central extended member, said semicircular disk sliding towards the working end whenever said hook is pulled, said semicircular disk sliding towards a center of said central extended member whenever said hook is raised towards a vertical or pushed through the fluid medium.

7. The water hook of claim 6 wherein said semicircular disk has radially oriented and circumferential oriented supporting structure to minimize distortion of said grasping element when pulled.

8. The water hook of claim 1 wherein said water grasping element is a rectangular shaped scoop with a concavity directed towards the handle, the rectangular shaped scoop slidingly attached to the central extended member, said rectangular shaped scoop sliding towards the working end whenever said hook is pulled, said rectangular shaped scoop sliding towards a center of said central extended member whenever said hook is raised towards a vertical or pushed through the fluid medium.

9. The water hook of claim 8 said rectangular shaped scoop has supporting structure to minimize distortion of said grasping in element when pulled.

10. A water hook used in combination with a boat-hook from a craft, said boat-hook having a handle at one end of a central extended member and a mar resistant bumper with a line grasping means at a working end of the extended member, the water hook used to propel said craft through a fluid medium, the water hook comprising:

a concave disk with the concavity directed towards the handle;

said concave disk having a high fluid resistance to movement; the disk slidingly attached to the central extended member; said disk sliding towards the working end to propel the craft whenever said water hook is pulled through said fluid medium, said disk sliding towards the center of said central extended member whenever said hook is raised towards the vertical or pushed through the fluid medium.

11. The water hook of claim 10 where said concave disk is hexagonal.

12. The water hook of claim 11 living radially oriented and circumferential oriented supporting structure to minimize distortion of said disk when pulled.

13. The water hook of claim 10 having radially oriented and circumferential oriented supporting structure to minimize distortion of said disk when pulled.

14. The water hook of claim 10 wherein said disk is semicircular.

15. The water hook of claim 14 having radially oriented and circumferential oriented supporting structure to minimize distortion of said disk when pulled.

16. The water hook of claim 10 wherein said disk is rectangular.

17. The water hook of claim 16 having supporting structure to minimize distortion of said disk when pulled.

18. A water hook used in combination with a boat-hook to propel a craft through a fluid medium, said boat-hook having a handle at one end of a central extended member, a mar resistant bumper and a line grasping means at the other end of the extended member, the water hook comprising:

a concave water grasping means near the other end with the concavity directed towards the handle, the water grasping slidingly attached to the central extended member, said water grasping means sliding towards the other end whenever said water grasping means is pulled, said water grasping means sliding towards a center of said central extended member whenever said water grasping means is raised towards the verticals pushed through the fluid medium.

19. The water hook as claimed in 18 where said water grasping means is a disk.

20. The water hook as claimed in 18 where said water grasping means is a semicircular disk.

21. The water hook as claimed in 18 where said water grasping means is a rectangular scoop.

22. A water hook used to propel a craft through a fluid medium comprising:

an extended central member;

a handle at a near end of said central member;

a working end at the other end of said central member;

a semicircular disk with the concavity directed towards the handle at the working end;

radially oriented and circumferential supports integral to said disk to minimize distortion of said disk when pulled;

the disk having a high fluid resistance to movement propelling said craft whenever said disk is pulled b handle from said craft through the fluid medium.

23. A water hook used in combination with a boat-hook, said boat-hook having a handle, a central extended member, a working end with a mar resistant bumper and a line grasping means, the water hook comprising:

a plurality of supports hinged to said central extended member near the working end;

said supports joined to a flexible membrane to open in an umbrella fashion concave towards the handle whenever said hook is pulled and collapsed whenever said hook is raised towards the vertical or pushed through the fluid medium;

said membrane with supports open in an umbrella fashion having a high fluid resistance to movement propelling said craft whenever said water grasping element is pulled by the handle from said craft through the fluid medium;

means to collapse the membrane whenever said boat-hook is needed.

24. A water hook used in combination with a boat-hook, said boat-hook having a handle, a central extended member, a working end with a mar resistant bumper and a line grasping means, the water hook comprising:

a plurality of cords;

a collar surrounding said central extended member near the working end;

each cord tied at a first end to the working end and to the collar at the other end, each cord tied to be equally distant from each other and loose;

a flexible membrane attached to the cords spanning between the working end and a medium position on each cord; the membrane forming an open bowl supported by said cords with concavity towards the handle whenever said working end is pulled and collapses whenever said working end is pushed through the fluid medium, the open bowl having a high fluid resistance to movement propelling said craft whenever said water grasping element is pulled by the handle from said craft through the fluid medium;

means to collapse the open bowl whenever said boat-hook is needed.

25. A water hook used in combination with a boat-hook, said boat-hook having a handle, a central extended member and a mar resistant bumper and a line grasping means at a working end, the water hook comprising:

a plurality of supports hinged to said central extended member near the working end to open in an umbrella fashion concave towards the handle whenever said hook is pulled and closes whenever said hook is raised towards the vertical or pushed through the fluid medium;

said supports having a high fluid resistance to movement propelling said craft whenever said water hook is pulled by the handle from said craft through a fluid medium;

means to close the supports whenever said boat-hook is needed.

26. A water hook used in combination with a boat-hook, said boat-hook having a handle, a central extended member and a mar resistant bumper and a line grasping means at a working end, the water hook comprising:

a plurality of cords;

a collar surrounding said central extended member near the working end;

the cords loosely spanning from the working end to the collar equally distant from each other;

a flexible membrane attached to the cords loosely spanning between the working end and a medium position on each cord;

the membrane forming an open bowl supported by said cords with concavity towards the handle whenever said working end is pulled through the fluid medium and a closed structure whenever said working end is pushed through the fluid medium;

the membrane in an open position having a high fluid resistance to movement propelling said craft whenever said water membrane is pulled by the handle from said craft through a fluid medium;

means to close the grasping element whenever said boat-hook is needed.

* * * * *